US005389058A

United States Patent [19]

Tinari

[11] Patent Number: 5,389,058

[45] Date of Patent: Feb. 14, 1995

[54] METHOD AND APPARATUS FOR EXERCISING THE LOWER BACK

[75] Inventor: Paul D. Tinari, Coquitlam, Canada

[73] Assignee: Torrington Capital Limited, Vancouver, Canada

[21] Appl. No.: 139,275

[22] Filed: Oct. 18, 1993

[51] Int. Cl.[6] ..... A63B 31/08

[52] U.S. Cl. ..... 482/111; 482/55; 434/254; 441/61

[58] Field of Search ..... 482/55, 105, 111; 434/254; 441/61, 69, 76, 79; 472/128, 129; D21/230, 231, 237, 238, 239

[56] References Cited

U.S. PATENT DOCUMENTS

| | | | |
|---|---|---|---|
| D. 189,008 | 10/1960 | Foster | D21/231 |
| 1,590,484 | 6/1926 | Volker . | |
| 1,983,609 | 12/1934 | Hudson | 441/61 |
| 2,536,390 | 1/1951 | Pobochenko | 434/254 |
| 2,889,563 | 6/1959 | Lamb et al. . | |
| 3,521,312 | 7/1970 | Ganev . | |
| 3,671,987 | 6/1972 | Mayor . | |
| 4,037,280 | 7/1977 | Klepsch | 441/76 |
| 4,973,049 | 11/1990 | Ciolino | 482/111 |

FOREIGN PATENT DOCUMENTS

| | | | |
|---|---|---|---|
| 16537 | of 1905 | United Kingdom | 441/61 |

*Primary Examiner*—Stephen R. Crow
*Assistant Examiner*—Jeanne M. Mollo
*Attorney, Agent, or Firm*—Vinson & Elkins

[57] ABSTRACT

A device for exercising the lower back and upper leg region of a user which includes a foot mount for attachment of a user's foot and a planar, flexible fin affixed to the foot mount and extending perpendicular to a user's foot when attached thereto. Front and rear edges of the fin are substantially parallel to each other and form an acute angle with the plane of the sole.

12 Claims, 3 Drawing Sheets

METHOD AND APPARATUS FOR EXERCISING THE LOWER BACK

FIELD OF THE INVENTION

The present invention relates to a method of exercising the lower back to alleviate lower back pain and to develop and strengthen the leg and lower back muscles.

BACKGROUND OF THE INVENTION

One of the most common health problems and one of the most debilitating is lower back pain. As a result there have been developed exercises specially designed for persons with such afflictions. Unfortunately, most of these cannot effectively exercise the most critical muscle groups in the lower spinal region, namely, the muscles running vertically along each side of the spine. Water has been recognized as a valuable medium in which to carry out therapeutic exercises. The conventional horizontal "dolphin type" flippers have been used in such remedial exercise programs to exercise muscles in the lower back and legs. However, such exercise programs are not only ineffective to relieve lower back pain but may actually lead to increased levels of such pain.

Other types of aquatic devices designed to provide remedial exercise rather than simply enhance swimming are not optimized to exercise the deep set muscles in the lower back. Some swim fins which function differently than "dolphin type" flippers include that disclosed in U.S. Pat. No. 3,521,312 issued to Ganev. Ganev discloses a swim fin having a shoe and a fin extending from the base of the shoe perpendicular to the sole surface. Although Ganev does not disclose using the swim fin for exercising, it does disclose a structure that would increase resistance to sideways movement of the legs. However, the shape of the Ganev fin provides a symmetrical gradually increasing area extending downwardly from the center of the sole of the foot of the user. With such a configuration the efficiency of transfer of force to the water is relatively small as the effective center of area of the fin is relatively far from the user's foot.

Volker, in U.S. Pat. No. 1,590,484, discloses a fin which has an area distribution closer to the user's foot but which extends downwardly and to one side so that it transfers momentum to the water much more effectively in one direction than the other. The Volker fin is specifically designed for enhancing a swimmer's performance of the breast stroke.

Accordingly, it is an object of the invention to provide an improved aquatic device for exercising the lower back and upper legs.

SUMMARY OF THE INVENTION

According to the invention there is provided an aquatic device for exercising the lower back and upper leg region of a user. The device includes a foot mount for attachment of a user's foot and a planar, flexible fin affixed to the foot mount and extending perpendicular to a user's foot when attached thereto. A front edge of the fin extends forwardly of a user's toe.

Preferably a rear edge extends forwardly from a heel of a user's toe. The front edge may form an acute angle with the plane of the sole.

The acute angle may be such that with a user in a pool of water and lying either on his stomach, his side or his back, the user's ankle is relaxed and front and rear edges of said fin are substantially parallel to the surface of said water.

The fins each have ribs extending along the front and rear edges thereof so as to provide stiffening of the fin. Advantageously, the foot mount may be a foot enclosure having a sole and an upper foot receiving opening.

In another aspect of the invention there is provided a method of exercising the lower back and upper leg muscles, which includes mounting on one's feet a pair of swim fins with each fin having a foot mount and a fin extending perpendicular to a sole of a user when attached to said foot mount with front and rear edges of the fin at an acute angle to the sole. The method includes suspending ones body in a pool of water and moving one's lower back and upper legs from side to side in a slow undulating fashion.

The acute angle may advantageously be of a magnitude such that when a user is parallel to the surface of a body of water, the front and rear edges of the fin are also substantially parallel to the surface of the water.

Such movement results in the exercising of the otherwise hard to exercise muscle groups in the lower back and the upper legs. The resistance of the fins may be adjusted by using fins of different areas. The present fin concept may be used by persons without back injury as a high level conditioning workout of hard-to-exercise muscle groups in the lower back and upper leg region.

BRIEF DESCRIPTION OF THE DRAWINGS

The novel features believed characteristic of the invention are set forth in the appended claims. The invention itself, as well as other features and advantages thereof, will be best understood by reference to the description which follows read in conjunction with the accompanying drawings, wherein:

DETAILED DESCRIPTION WITH REFERENCE TO THE DRAWINGS

Figure 1:
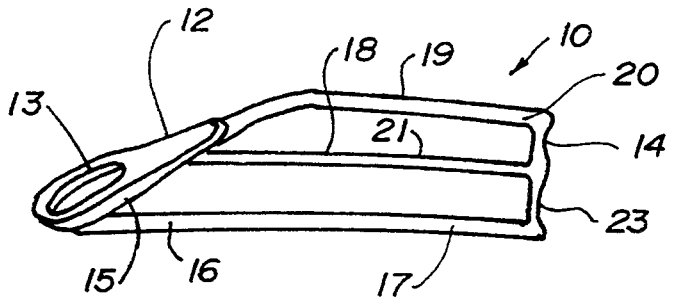
FIG. 1 is a side elevation view of the swim fin.
Figure 2:
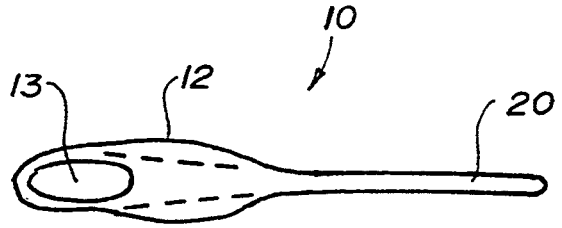
FIG. 2 is a top view of the fin of FIG. 1.

Referring to FIGS. 1 to 2, there is shown the swim fin 10 which consists of a foot mounting portion 12 having a foot opening 13 and a sole portion 15. Extending in a plane substantially perpendicular to the sole portion 15 is a flexible fin 14 of water impermeable material such as urethane having strengthening ribs 16, 18 and 20 along the rear 17, the middle 21 and the front 19, respectively, which are substantially parallel to one another. Ribs 16, 18 and 20 are thickened spines which are tapered in that they become slightly thinner with increasing distance from the sole of the foot mounting enclosure. The angle between the fin 14 and the plane of the sole 15 is approximately 90 degrees with the fin oriented in the same direction as the foot mounting portion 12. The angle each spine or rib 16, 18 or 20 makes with the plane of the sole 15 is an acute angle such that, with the ankle relaxed and the user parallel to the surface of the water, the ribs or spines 16, 18 and 20 are substantially parallel to the surface of the water.

Figure 3:
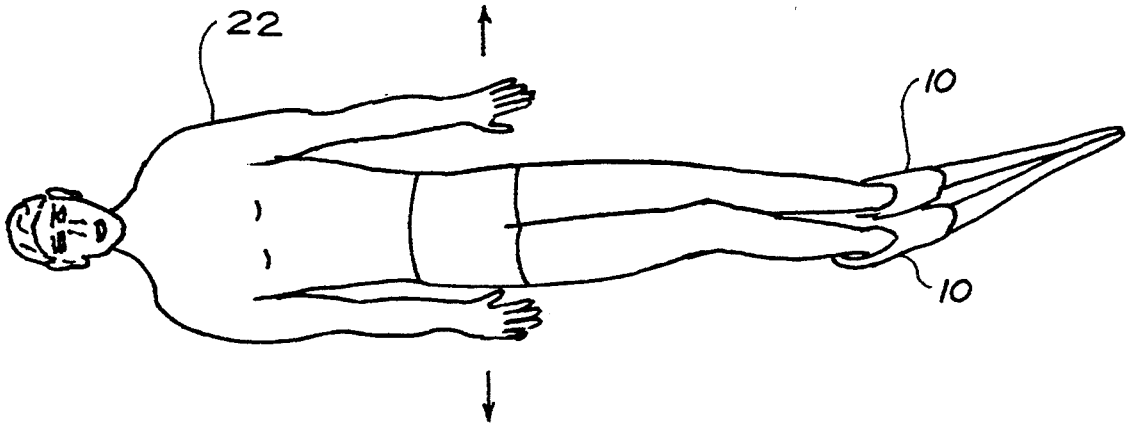
FIG. 3 is a top view of a user swimming on his back and wearing the fins showing the direction of leg movement.
Figure 4:
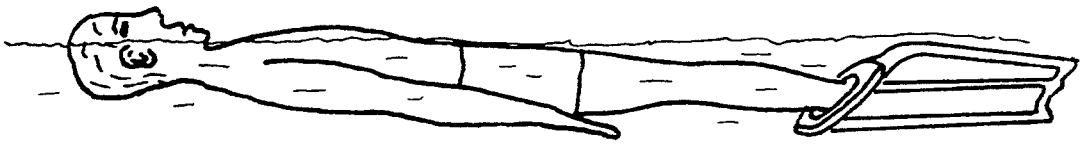
FIG. 4 is a side elevation view of a user with the swim fins floating in a pool of water.

The rigidity of the fin 10 and ribs 16, 18 and 20 should be such that the fin 10 substantially retains its general shape when subjected to flow resistance during aquatic movements. In use as shown in FIG. 3 a user 22 inserts his feet into the foot mounting portions 12. When in the water, the user 22 floats on his back and performs a series of slow "side-to-side" undulating movements with his lower back and legs while keeping his feet loosely together and his legs straight, as shown in FIG. 4. The motion can be performed while holding onto a railing in a small therapeutic pool, or while swimming lengths in a large pool. Although it is preferable for a user 22 to perform these exercises while on his back, it is also possible to perform the same exercise while on his side or face down. However, obviously breathing is a problem in the latter case. The fins 10 allow such movement at a time when all of the user's weight is removed from his spine. Slightly different muscle groups are exercised depending whether the user is on his back, side or face down.

Clearly, the fins may have additional features to increase their effectiveness such as slots, grooves, notches, extension blades or articulating transverse hydrofoil blades.

Figure 5:
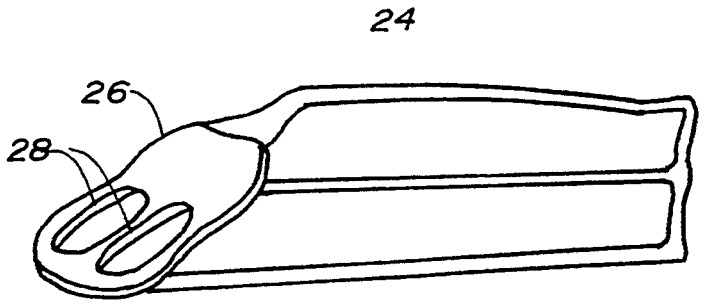
FIG. 5 is a single fin which accommodates both feet of a user.

Instead of using separate fins for each foot one can use the device shown in FIG. 5 which is a single fin 24 having a double foot mounting 26 with openings 28 that accommodate both feet of a user. The motion is similar to that of a shark in the water. The exercise is effective on the following lower back muscles: the sacro-spinalus longissimus, the sacro-spinalus iliocostalis, the iliocostalis lumborum, the quadratus lumborum and the multifidus. In the abdominal region the muscles most intensely exercised are the rectus abdominus, the obliquus externus, the obliquus internus and the transversus abdominus. In the pelvic group the muscles most specifically exercised are the gluteus minimus, the gluteus medius, the piriformis, the obturator internus, the gamelli and the iliopsoas. Finally, in the thigh group the muscles exercised are the tensor fasciae latae, the quadratus femoris, the adductor magnus and the ilio-tibial tract.

Figure 6:
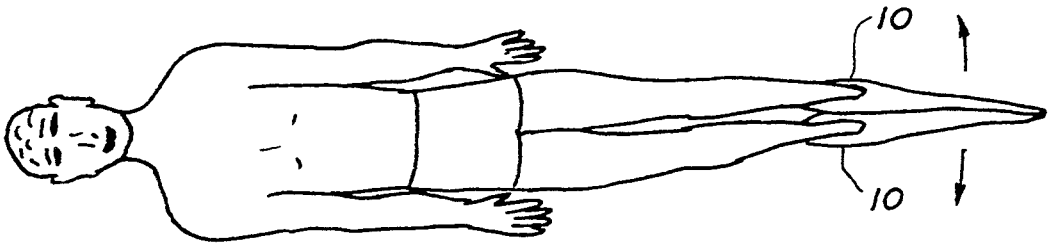
FIG. 6 shows a user on his back in the water wearing the fin of FIG. 5 and showing movement involved in exercising.

Referring to FIG. 6, the fins 10 may be used to exercise other muscle groups as well. For example, by simply moving the legs apart and then together, the three sets of abductor muscles on the inside of the leg, the three or four sets of extensors on the outside of the leg and the inside and outside of the knee are all exercised.

Figure 7:
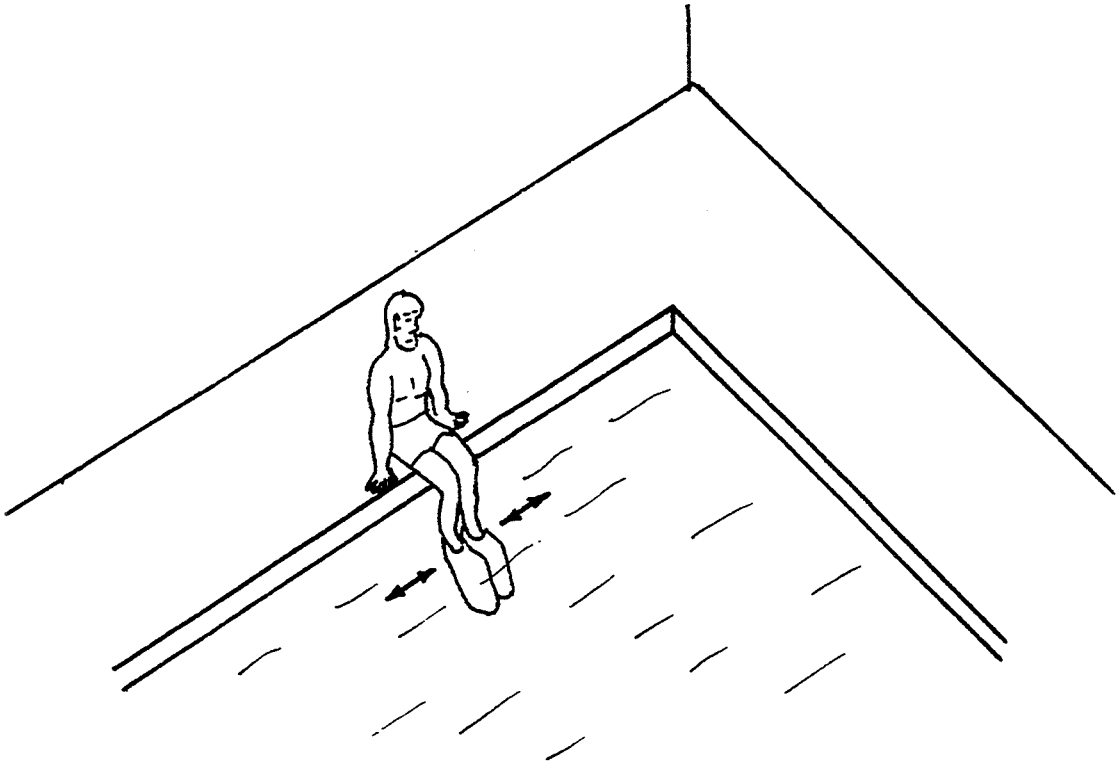
FIG. 7 shows a person at the side of a pool with the fins on exercising his ankles and leg muscles.

Extremely effective therapy of the ankle and leg muscles can be achieved by simply sitting on the side of a pool and moving the legs as seen in FIG. 7.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modification or embodiments as fall within the true scope of the invention.

I claim:

1. A lower back and upper leg exercising device, comprising:

(a) foot mount for attachment of a foot of a user having a toe region for receiving a user's toe and a heel region for receiving a user's heel; and (b) a planar, flexible fin member affixed to said foot mount and extending in a plane perpendicular to a foot mount plane and substantially parallel to a notional line through the center of the foot mount along the length thereof, said foot mount adapted to contain the sole of the foot of the user when his foot is inserted into the foot mount, said fin member having a front edge extending out from said foot mount at a location proximate said toe region and inclined from the foot mount plane forwardly of the toe region and at an acute angle to the foot mount plane thereby allowing the user to maintain the front edge of the fin substantially parallel to the surface of water in a pool when the user is floating in the supine or prone position and user's ankle is in a relaxed, neutral position.

2. A device according to claim 1, wherein a rear edge of said fin member extends out from the foot mount at the heel region forwardly thereof and substantially parallel to the front edge.

3. A device according to claim 1, wherein said acute angle is substantially equal to the angle a normal persons foot makes with his leg partially bent and with his foot is in a relaxed, neutral position.

4. A device according to claim 2, including ribs extending along the front and rear edges so as to provide stiffening of said fin.

5. A device according to claim 1, wherein said foot mount is a foot enclosure having a sole and an opening at a top thereof adapted to receive a user's foot.

6. A device according to claim 1, wherein said foot mount has two foot enclosures with two corresponding openings at a top thereof to receive both feet of a user.

7. A method of exercising the lower back and upper leg muscles, comprising:

mounting on ones feet a pair of swim fins with each fin having a foot mount and a fin member extending perpendicular to a foot mount plane;

suspending one's body in a pool of water; and moving one's lower back and upper legs from side to side in a slow undulating fashion while keeping the legs loosely together.

8. A method according to claim 7, wherein said suspending step includes floating on one's back while moving his lower back and legs.

9. A method according to claim 7, wherein said suspending step includes floating on ones stomach while moving his lower back and legs.

10. A method according to claim 7, wherein said suspending step includes floating on one's side while moving his lower back and legs.

11. A method of exercising the lower back and upper legs, comprising:

mounting on one's feet a swim fin having a pair of foot mountings, a single fin member substantially perpendicular to a plane through a surface of said foot mountings and having a front edge extending out forwardly of a user's foot, when inserted into the foot mountings, at an acute angle to said plane;

floating in a pool of water; and moving one's lower back and upper legs from side to side in a slow undulating motion.

12. A method of exercising the lower back and upper legs, comprising:

(a) mounting on one's feet a pair of swim fins with each fin having a foot mount and a fin member extending perpendicular to a foot mount plane;

(b) inserting one's legs into a pool of water;

(c) moving one's lower back and upper legs from side to side in a slow undulating fashion which keeping the legs loosely together.

* * * * *